US005586912A

United States Patent [19]

Eslampour et al.

[11] Patent Number: 5,586,912

[45] Date of Patent: Dec. 24, 1996

[54] HIGH DENSITY FILTERED CONNECTOR

[75] Inventors: Robert A. Eslampour, Norwalk; Robert J. Shiley, II, Monroe; Allan W. Hendry, Norwalk, all of Conn.

[73] Assignee: Burndy Corporation, Norwalk, Conn.

[21] Appl. No.: 411,397

[22] Filed: Mar. 28, 1995

Related U.S. Application Data

[63] Continuation of Ser. No. 973,827, Nov. 9, 1992, abandoned.

[51] Int. Cl.[6] ..... H01R 13/66

[52] U.S. Cl. ..... 439/620; 439/95

[58] Field of Search ..... 439/95, 607, 620; 29/629, 843; 333/79, 182–185

[56] References Cited

U.S. PATENT DOCUMENTS

| | | | |
|---|---|---|---|
| 3,579,155 | 5/1971 | Tuchto et al. | 333/79 |
| 3,947,959 | 4/1976 | DuRocher | 29/629 |
| 4,020,430 | 4/1977 | Vander Heyden | 439/620 X |
| 4,275,945 | 6/1981 | Krantz et al. | 439/620 X |
| 4,371,226 | 2/1983 | Brancaleone | 439/620 X |
| 4,440,463 | 4/1984 | Gliha, Jr. et al. | 439/620 X |
| 4,458,220 | 7/1984 | Carter et al. | 333/182 |
| 4,500,159 | 2/1985 | Briones et al. | 439/620 X |
| 4,519,665 | 5/1985 | Althouse et al. | 339/147 R |
| 4,582,385 | 4/1986 | Couper et al. | 439/620 X |
| 4,674,815 | 6/1987 | Chambers et al. | 439/620 X |
| 4,699,590 | 10/1987 | Farrar et al. | 439/620 X |
| 4,820,174 | 4/1989 | Farrar et al. | 439/95 |
| 4,929,196 | 5/1990 | Ponn et al. | 439/620 |
| 4,954,794 | 9/1990 | Nieman et al. | 333/182 |
| 5,011,434 | 4/1991 | Blunt | 439/620 |
| 5,066,931 | 11/1991 | Thelissen | 333/182 |

OTHER PUBLICATIONS

"EMI/RFI Filter Connectors", Catalog, Souriau Inc., pp. 1–22, 1990.

*Primary Examiner*—Peter Vo
*Attorney, Agent, or Firm*—Perman & Green

[57] ABSTRACT

A filtered electrical connector includes a housing, filter contacts, and a ground plane member. The filter contacts include a contact member and, a tubular capacitor connected to the contact member. The capacitor is mounted over the contact member and sandwiched between a ledge of the contact member and an end of a crimping sleeve with conductive elastomeric washers compressed therebetween. The ground plane member has receiving apertures to receive and make contact with the filter contacts and, contact legs. A separate contact leg is provided for each receiving aperture. Each of the legs makes contact with the housing.

31 Claims, 3 Drawing Sheets

FIG. 9
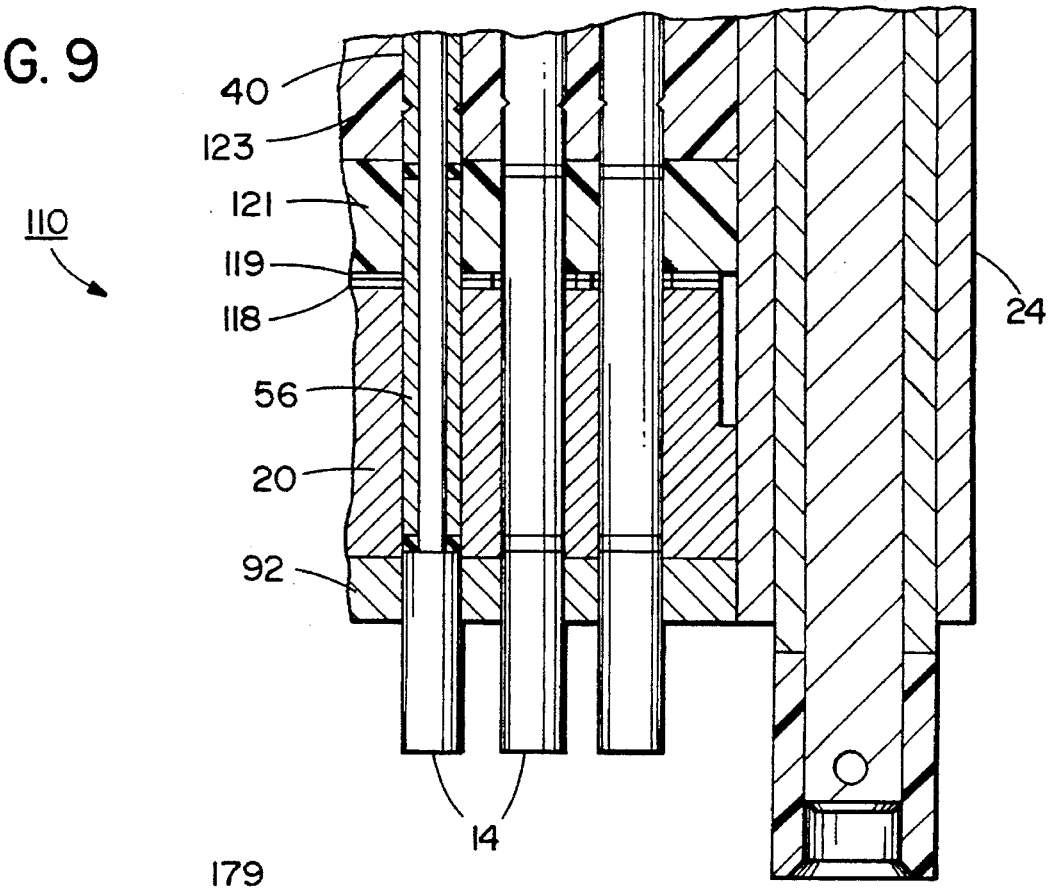
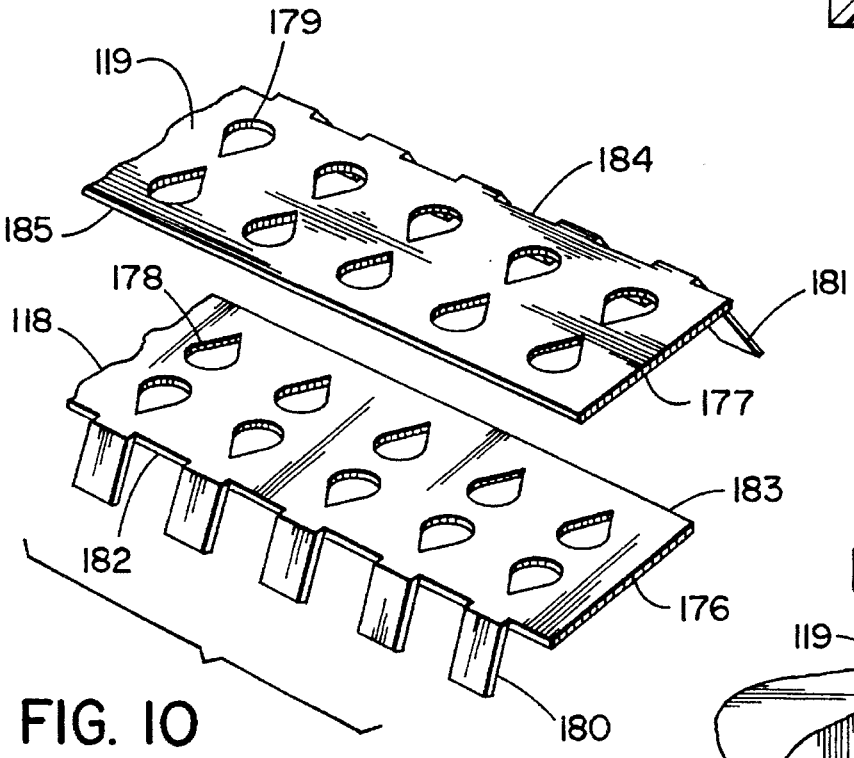
FIG. 10
FIG. 11
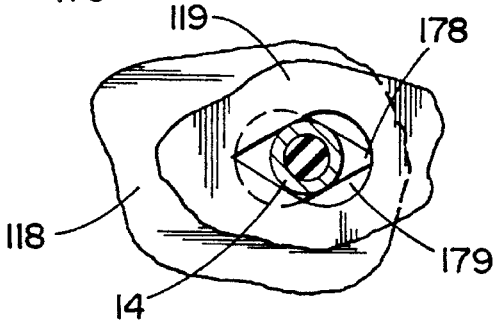

HIGH DENSITY FILTERED CONNECTOR

This is a continuation of application Ser. No. 07/973,827 filed on Nov. 9, 1992, now abandoned.

BACKGROUND OF THE INVENTION

1. Field of the Invention

The present invention relates to electrical connectors and, more particularly, to a ground plane used in a filtering connector.

2. Prior Art

U.S. Pat. No. 5,011,434 to Blunt discloses a filtered electrical connector with contacts having a ceramic filter capacitive casing, conductive rubber spacers held in compression, and a rear portion crimped onto a central conductor. U.S. Pat. No. 4,458,220 to Carter et al. discloses an electrical connector and filter circuit with a film electrode having a spring-like contact which interconnects a terminal of a capacitor to an electrically conductive ground shell. U.S. Pat. No. 4,519,665 to Althouse et al. discloses a filtered connector with a grounding member having a patterned array of apertures profiled with inwardly directed tines and a resilient flange at opposite ends. Other relevant art includes U.S. Pat. No. 4,820,174; 3,947,959; 3,579,155; 4,954,794; 5,066,931; and 4,929,196.

A problem has been encountered in regard to prior art filtered connectors; namely, high density filtered connectors that operate properly with contacts in close proximity to each other have not been available. It is therefore an object of the present invention to provide a new and improved filtered connector.

SUMMARY OF THE INVENTION

In accordance with one embodiment of the present invention, a filtered electrical connector is provided comprising an electrically conductive housing, a plurality of contacts located, at least partially, in the housing, a plurality of ceramic tubular capacitors connected to the contacts, and at least one ground plane member. The ground plane member has a center section and legs extending from the center section. The center section has a plurality of receiving areas with each one of the capacitors being located in one of the receiving areas and making electrical contact there at. Each of the receiving areas, at least along one side of the center section; has a separate one of the legs proximate thereto. Each leg has a bend proximate the center section and has an end that contacts the housing.

In accordance with another embodiment of the present invention, a filtered electrical connector ground plane member for use in a connector having filtering contacts is provided. The ground plane member comprises a center section and leg sections. The center section has two rows of receiving apertures, each aperture having inwardly directed deflectable barbs. The leg sections extend from two sides of the center section. Each leg section extends from the center section proximate one of the receiving apertures. Each receiving aperture has a leg associated therewith such that the ground plane member can make electrical contact with each capacitor at the barbs in one of the receiving apertures and a connector housing at an end of one of the legs.

In accordance with another embodiment of the present invention a filtered electrical connector is provided comprising a housing, a plurality of filtered contacts, and a ground plane member. The filtered contacts are located at least partially in the housing. Each filtered contact has a contact member and a tubular capacitor. The ground plane member is connected between the housing and the capacitors of the filtered contacts. The ground plane member has pairs of contact receiving apertures and contact legs arranged in two rows. Each of the contacts is located in one of the receiving apertures and makes electrical contact with the ground plane member thereat. Each of the contact legs makes contact with the housing.

In accordance with another embodiment of the present invention, an electrical connector is provided with a housing, a plurality of contacts located in the housing, and a pair of ground plane members. The pair of ground plane members are located in the housing and electrically connect at least some of the contacts to the housing. The ground plane members each comprise a center section with receiving areas and legs extending from the center section. The ground plane members are sandwiched together with at least some of the contacts passing through pairs of overlapping receiving areas and making electrical contact thereat and, the legs of the ground plane members extending from opposite sides of the center sections, one leg for each of the pairs of overlapping receiving areas.

BRIEF DESCRIPTION OF THE DRAWINGS

The foregoing aspects and other features of the invention are explained in the following description, taken in connection with the accompanying drawings, wherein;

FIG. 9 is an enlarged partial cross-sectional view of an alternate embodiment of a connector incorporating features of the present invention.

FIG. 10 is a partial perspective view of two ground plane members used in the connector shown in FIG. 9.

FIG. 11 is a schematic view of a contact and how it is contacted by the ground plane members shown in FIG. 10.

DETAILED DESCRIPTION OF THE INVENTION

Figure 1:
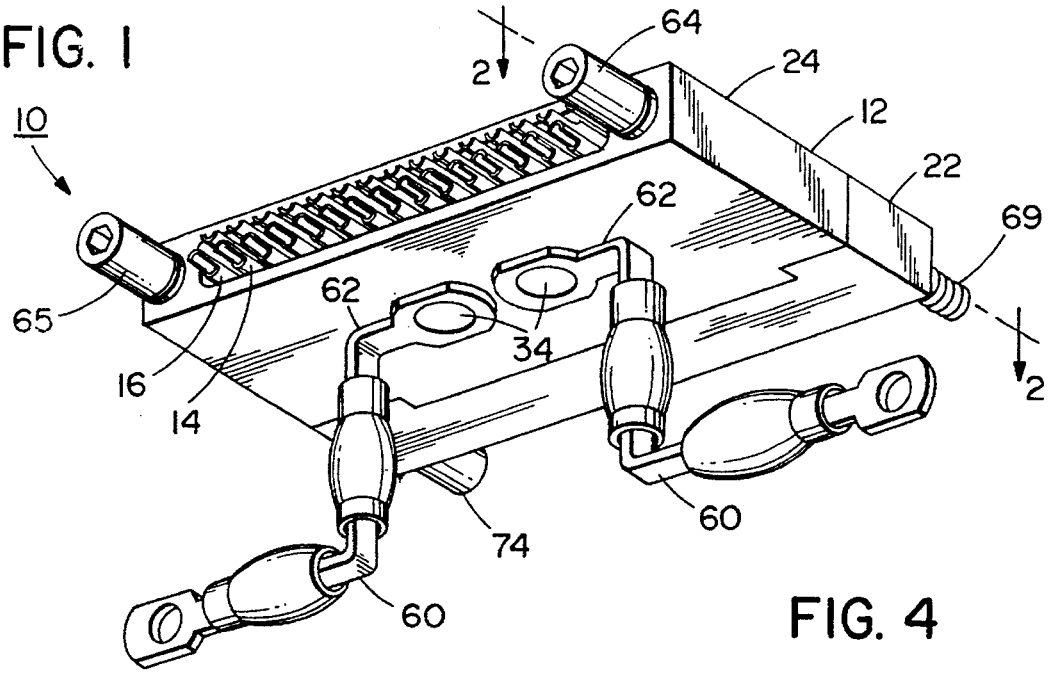
FIG. 1 is a bottom, front and side perspective view of a high density filtered connector incorporating features of the present invention.

Referring to FIG. 1 there is shown a perspective view of a high density filtered connector 10 incorporating features of the present invention. Although the present invention will be described with reference to the embodiments shown in the drawings, it should be understood that features of the present invention may be embodied in various different alternative embodiments. In addition, any suitable size, shape or type of members or materials could be used.

Figure 2:
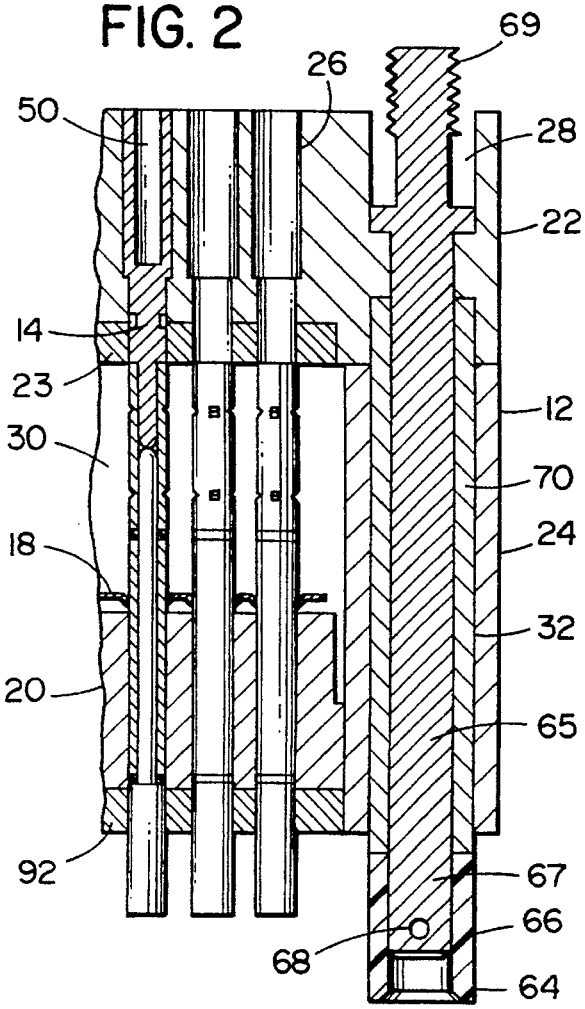
FIG. 2 is a partial cross-sectional view of the connector shown in FIG. 1 taken along line 2—2.
Figure 3:
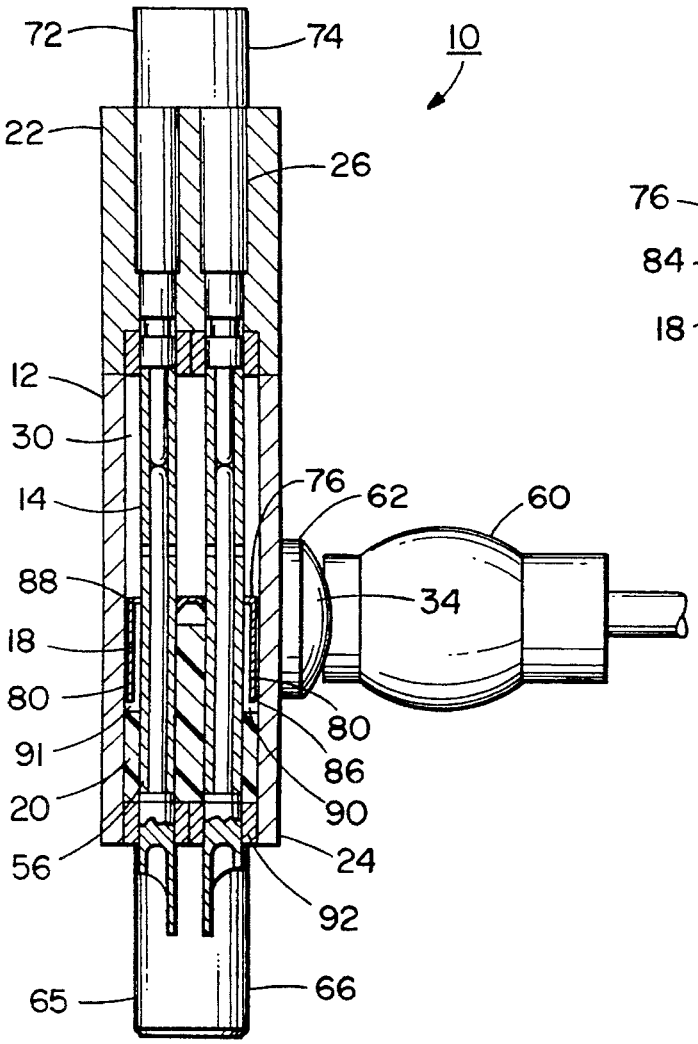
FIG. 3 is an offset cross-sectional view of the connector shown in FIG. 1; offset through the center axis of the connector.

Referring also to FIGS. 2 and 3, the connector 10 generally comprises a housing 12, filtered contacts 14, non-filtered contacts 16, a ground plane member 18, and a grommet 20. The housing 12, in the embodiment shown, generally comprises a first housing member 22 made of dielectric material fixedly connected to a second housing member 24 made of electrically conductive metal, such as extruded or machined aluminum. Preferably, the two housing members 22 and 24 are epoxy bonded together. However, the housing could be provided as a single member or more than two members and, multiple members can be connected in any suitable manner. The first housing member 22 has two rows of offset contact receiving apertures 26 and two fastener apertures 28 at opposite ends of the rows of apertures 26. However, any suitable pattern could be provided. The second housing member 24 includes a center channel 30, two fastener end channels 32, and two integral mounting lugs 34. However, any suitable type of second housing could be provided.

In the embodiment shown, the two mounting lugs 34 are provided for electrically and mechanically connecting ground wire assemblies 60 to the second housing member 24. The assemblies 60 have terminals 62 that are placed over the undeformed mounting lugs. The mounting lugs are then deformed, preferably by an orbital riveter, to fixed mount the assemblies 60 to the second housing member 24. Opposite ends of the assemblies 60 can then be connected to a ground to thereby ground the second housing member 24.

The connector 10 also comprises two fasteners 64 and 65 for removably connecting the connector 10 to a second connector (not shown). The first fastener 64 has a hex head 66 fixedly connected to a first end 67 of jackscrew 65 by an interference dowel pin 68, and a tube 70 surrounding the dowel pin 68. The tube 70 is provided such that the jackscrew 65 can axially rotate and, cooperates with the hex head 66 to keep the jackscrew 65 at a substantially set location relative to the housing 12. An opposite second end 69 of the dowel pin 68 is threaded. The first fastener 64 is stationarily positioned on the housing 12 in one of the apertures 28 and channels 32 except it is able to axially rotate as noted above. The second fastener 65 is of a similar design, but instead of a jackscrew, it has a jacksocket 72 with a second end 74 that has a threaded socket. By having a jacksocket at one end and a jackscrew at the other end, this insures that the connector 10 will not be connected to another mating connector in an upside-down position. However, any suitable type of fastening system could be provided.

Figure 7:
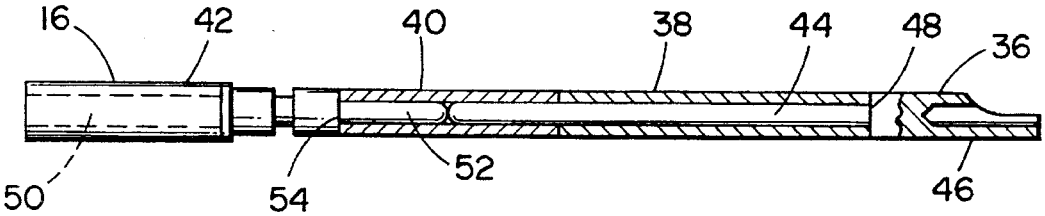
FIG. 7 is a partial cross-sectional view of one of the non-filtered contacts used in the connector shown in FIG. 1.
Figure 8:
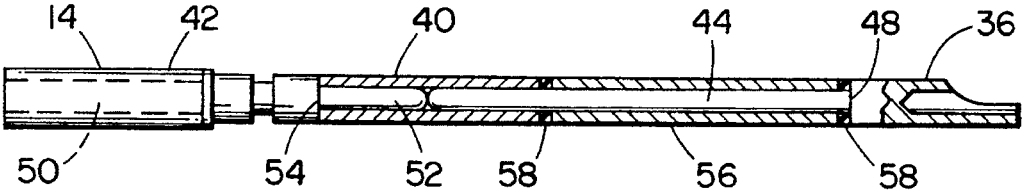
FIG. 8 is a partial cross-sectional view of one of the filtered contacts used in the connector shown in FIG. 1.

Referring also to FIGS. 7 and 8 partial cross-sectional views of a non-filtered contact 16 and a filtered contact 14 are shown, respectively. In the connector 10 shown, the connector has thirty contacts; six non-filtered contacts 16 and twenty-four filtered contacts 14. However, any suitable number or proportion of contacts could be provided. It should also be understood that non-filtered contacts are not required and, that any suitable combination or arrangement of filtered and non-filtered contacts can be provided. The non-filtered contact 16 generally comprises a contact extender 36, an insulator 38, a crimp tube 40, and a socket contact member 42. The contact extender 36 is preferably provided as a one-piece metal member with a shaft section 44 and a solder cup section 46. The solder cup section is provided such that an electrical wire can be soldered to the contact 16 at the solder cup section. However, any suitable type of connection terminal could be provided. In the embodiment shown, the extender 36 has a ledge 48 at the junction of the two sections 44 and 46.

The insulator 38 is located over the shaft section 44. In a preferred embodiment, the insulator 38 is shrink tubing. The socket contact member 42 is made of metal and includes a socket area 50, a shaft section 52, and a ledge 54 therebetween. The socket area 50 is adapted to receive a male contact from the second connector (not shown). The shaft section 52 is the same diameter as the shaft section 44. The ends of the two shaft sections 44 and 52 face each other with the crimp tube 40 covering the ends of the shaft sections 44 and 52. The crimp tube 40 is crimped on the two shaft sections 44 and 52 to thereby fixedly connect the socket contact member 42 to the contact extender 36. The ledges 48 and 54 cooperated with the ends of the crimp tube 40 and insulator 38 to keep the insulator 38 on the shaft section 44 at a set location. In a preferred method of crimping the crimp tube 40 to the shaft sections 44 and 52, two sets of crimping dies are used, one set for the crimp to the first shaft section 44 and the other set for the crimp to the second shaft section 52. Each set has four teeth offset 90° from each other in order to indent the crimp tube 40 at four spaced, but predetermined locations about a cross-section of the crimp tube 40.

The filtered contact 14 is very similar to the non-filtered contact 16. However, instead of insulator 38, the filtered contact 14 has a ceramic tubular capacitor 56 and two conductive elastomeric rings 58. The contact 14 includes a contact extender 36, a crimp tube 40, a socket contact member 42 identical to those described with reference to the non-filtered contact 16 described above. The capacitor 56 is mounted over the extender shaft section 44 with one of the rings 58 sandwiched between a first end of the capacitor 56 and the ledge 48. The second ring 58 is sandwiched between a second end of the capacitor 56 and an end of the crimp tube 40. The ledges 48 and 54 cooperate with the crimp tube 40 and capacitor 56 to compress the rings 58 to allow for good electrical contact with the ends of the capacitor 56.

Figure 4:
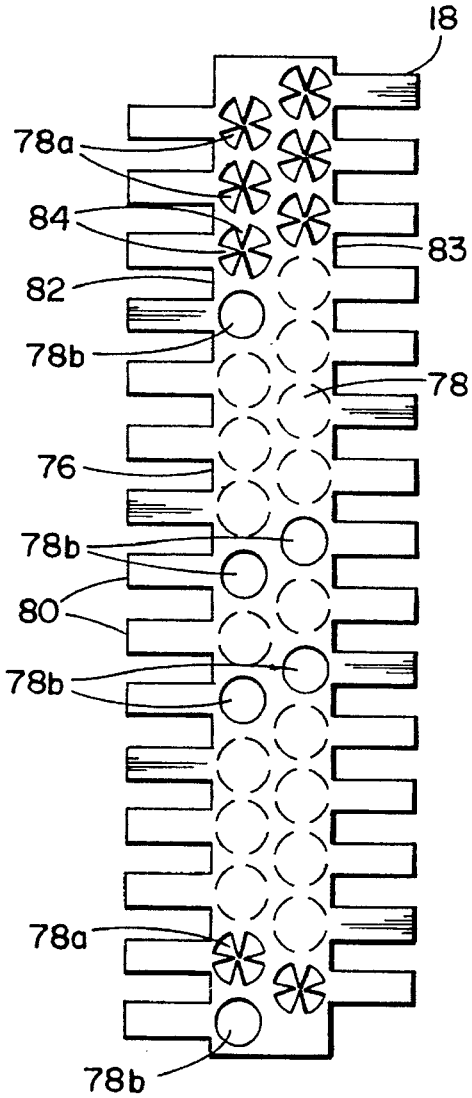
FIG. 4 is a plan top view of a ground plane member used in the connector shown in FIG. 1.
Figure 5:
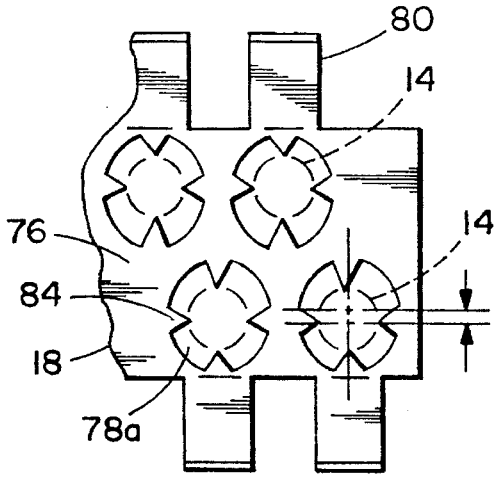
FIG. 5 is an enlarged view of one end of the ground plane member shown in FIG. 4.
Figure 6:
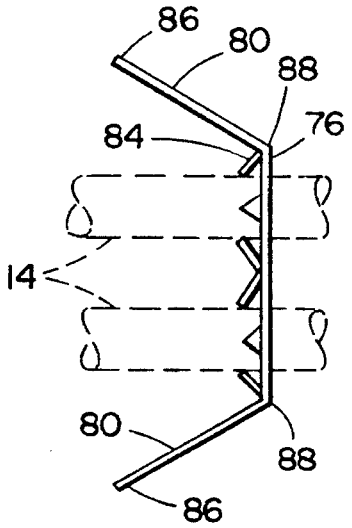
FIG. 6 is a side view of the ground plane member shown in FIG. 5.

Referring also to FIGS. 4–6, the ground plane member 18 is shown. FIG. 4 shows the ground plane member 18 before it is inserted into the housing 12 and prior to connection with the contacts 14 and 16. The ground plane member 18 is preferably made of a sheet metal member that is cut, such as by stamping and/or chemically etched, into the shape shown. Preferably, the member 18 is comprised of beryllium copper and plated with tin lead or silver; at least at selected contact areas. The member 18 has a center rectangular section 76 with two offset rows of receiving apertures 78, and leg sections 80 extending from two sides 82 and 83 of the center section 76. In the embodiment shown, a total of thirty receiving apertures 78 are provided, one for each of the contacts. There are two types of apertures provided. A first type of aperture **78*a* has four inwardly directed deflectable barbs 84. The second type of apertures 78*b* do not have barbs. Six of these second type of apertures 78*b* are provided for the non-filtered contacts 16. The first type of apertures 78*a* are provided for the filtered contacts 14. In the embodiment shown, the first type of apertures 78*a* have their barbs 84 non-symmetrically arranged. The interference barbs 84 are non-symmetrically arranged to insure that interference fit between the barbs 84 and contacts 14 is not great enough to deform the barbs 84 beyond elastic deformation, but nonetheless provide the apertures 78*a* as small as possible. Therefore, the non-symmetrical arrangement of apertures 78*a* and barbs 84 makes room for the barbs to elastically deflect. In the embodiment shown, there are also thirty leg sections 80; one for each of the apertures 78. Each leg section 80 is associated with one of the apertures 78 by being in relatively close proximity thereto. This is done in order to provide a substantially short ground path between the first type of apertures 78***a* and their associated leg sections. The pairs of apertures 78 and leg sections 80 are aligned generally perpendicular to the center longitudinal axis of the center section 76 to provide the shortest possible ground path.

FIGS. 5 and 6 show the ground plane member 18 with contacts 14 shown in dashed lines just prior to insertion into the housing 12. As can be seen, with the filtered contacts 14 located in the first type of apertures 78*a*, the barbs 84 are deflected and securely grip onto the contacts 14 at the outer surface of the capacitors 56 to make electrical contact therewith. The leg sections 80 are also deflected in order to help ease insertion of the ground plane member 18 into the center channel 30. The non-filtered contacts 16 have their insulators 38 located at the second type of apertures 78*b*. Thus, the insulators 38 function to electrically insulate the contact extender 36 and socket contact member 42 from the ground plane member 18. When assembled, as best seen in FIG. 3, the leg sections 80 are further deformed or bent at bend 88 into a substantially perpendicular position relative to the center section 76. This deflection causes each of the leg sections 80 to be spring biased against the interior wall of the second housing member 24 in the center channel 30. Thus, the ends 86 of the leg sections make a good electrical contact with the second housing member 24.

The grommet 20 is preferably made of a resilient rubber or polymer material and includes thirty contact apertures and two side troughs 90 and 91. The contact apertures are about the same size as the outer diameters of the contacts 14 and 16 to thereby make a sealing engagement between the contacts and the grommet. The grommet 20 also makes a sealing engagement with the interior wall of the second housing member 24. The side troughs 90 and 91 are provided in order to provide space for the leg sections 80. Epoxy layer 92 is added to seal off and hold the grommet 20. The grommet 20 also prevents the epoxy from inadvertently interfering with the electrical contact between the leg sections 80 and the second housing member 24. Of course, an additional internal grommet (not shown) could be added in front of the ground plane member 18 to prevent the member 18 from inadvertently moving forward on the contacts 14. Alternative means for preventing the member 18 from moving forward could also be used.

One of the unique features of the present invention is the small size of the connector 10. This small size is accomplished due to the very close spacing and arrangement of the contacts. This very close spacing is accomplished due to the very short and direct grounding paths for each filtered contact by the fact that each filtered contact has a leg section and, each of the leg sections 80 are in very close proximity to one of the apertures 78 where contact with the capacitors 56 is made. This allows fast and direct grounding through the ground plane member 18 preventing the filtered contacts from interfering with each other.

Referring now to FIGS. 9–11, an alternate embodiment of the present invention will be described. The connector 110 is essentially similar to the connector 10 with three exceptions, therefore, reference should be made to the other figures for members not shown in FIGS. 9–11. The connector 110 has two ground plane members 118 and 119 rather than one. The connector 110 has an internal grommet 121. The connector 110 also has potting 123. The potting 123 is preferably an epoxy material that is poured or injected inside the second housing member 24 to hold the contacts 14 and 16 in place, assist the internal grommet 121 in sandwiching the ground plane members 118 and 119, and help connect the second housing member 24 to the first housing member 22. In a preferred method of manufacturing the connector 110 the potting 23 (see FIG. 2) is first poured to connect the contacts 14 and 16 to the first housing member 22, the second housing member 24 is then positioned against the first housing member 22, and then the potting 123 is poured. The potting 123 is preferably poured to a level up to the rear end of the crimp sleeve 40. The internal grommet 121 is then positioned in the second housing member 24 adjacent the hardened potting 123. The internal grommet 121 is preferably made of a resilient rubber of polymer material or RTV silicone. The internal grommet 121 helps to hold the ground plane members in place such that they will not move forward on the contacts 14 and inadvertently contact or pass insulative bands (not shown) on the capacitors 56. This type of barrier from internal grommet 121 may be necessary especially in high vibration environments, such as in an aircraft.

The two ground plane members 118 and 119 are then positioned adjacent the internal grommet 121; the second member 119 essentially stacked on top of the first member 118. The members 118 and 119 are each comprised of a single sheet of metal having center sections 176, 177 with two rows of receiving apertures 178, 179, and leg sections 180, 181. The first member 118 has its legs 180 extending only from a first side 182; not the opposite second side 183. The second member 119 has its legs 181 extending only from a second side 184; not the opposite first side 185. The receiving areas 178 and 179, in the embodiment shown, have a general teardrop shape. In the first member 118 the teardrop areas 178 face each other. In the second member 119 the teardrop areas 179 face away from each other. In alternate embodiments the teardrop receiving areas 178, 179 for each ground plane member could face in the same direction or be mixed so long as overlapping areas 178, 179 are reverse to each other. As seen best in FIG. 11, pairs of receiving areas 178, 179 overlap each other when the members 118, 119 are sandwiched together. The areas 178, 179 are larger than the contacts 14. However, the members 118, 119 combine to effectively sandwich the contacts 14 between the side walls in the areas 178, 179. However, in an alternate embodiment, the members 118, 119 could have receiving areas and barbs similar to receiving areas 78*a* and barbs 84 shown in FIG. 4.

One of the unique features of the multiple ground plane member design is the fact that legs 180, being spring loaded in side trough 90 of rear grommet 20 (see FIG. 3), bias the member 118 towards its second side 183. The legs 181, being spring loaded in side trough 91 (see FIG. 3), bias the member 119 towards its first side 185. This biasing of members 118, 119 in opposite directions helps to insure a reliable connection of members 118, 119 to the capacitor tubes 56 especially in harsh vibration environments. Of course, more than two ground plane members 118, 119 could be used. The members 118, 119 may also have legs on sides other than sides 182, 184. The dual ground plane members embodiment could be easier to assemble than the single ground plane member embodiment. The rear grommet 20 is positioned to sandwich the members 118, 119 between the two grommets 20, 121 and the epoxy layer 92 is then added. Because the two members 118, 119 are sandwiched together, substantially direct grounding paths from the contacts 14 to the second housing member 24 is still provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A filtered electrical connector comprising:

an electrically conductive housing;

a plurality of filtered contacts located, at least partially, in the housing, the filtered contacts each including a ceramic tubular capacitor; and at least one ground plane member having a center section and legs extending outwardly from the center section, the center section having receiving areas with each of the capacitors being located in one of the receiving areas and making electrical contact thereat, all of the receiving areas, at least along one side of the center section, each having a separate one of the legs proximate thereto, each leg having a bend proximate the center section and an end that contacts the housing.

2. A connector as in claim 1 wherein the filtered contacts include a first contact member, a second contact member, and a contact member connector to connect the first contact member to the second contact member.

3. A connector as in claim 2 wherein each of the capacitors surround a portion of the first contact member and are sandwiched between a ledge on the first contact member and an end of the contact member connector.

4. A connector as in claim 2 wherein the contact member connector surrounds portions of the first and second contact members and is crimped thereto.

5. A connector as in claim 1 wherein the ground plane member is comprised of a single sheet metal member.

6. A connector as in claim 1 wherein at least one of the receiving areas has inwardly projecting barbs for contacting one of the capacitors.

7. A connector as in claim 1 wherein the center section has a general rectangular shape, the receiving areas are aligned in two offset rows, and the legs extend from only two sides of the center section.

8. A connector as in claim 1 further comprising a grommet connected to the housing and epoxy fixedly holding the grommet to the housing.

9. A connector as in claim 1 wherein the housing includes a first housing member made of dielectric material, and a second housing member made of metal, the second housing member having integral lugs on an exterior side thereof adapted to be deformed to fixedly connect a ground wire assembly thereto.

10. A connector as in claim 1 wherein the connector has two ground plane members.

11. A connector as in claim 10 wherein each ground plane member has legs extending along one side, but not an opposite side and, the two ground plane members are stacked one on top of the other in opposite orientations such that the legs extend from opposite sides of the stacked ground plane members.

12. A connector as in claim 10 wherein the two ground plane members are stacked one on top of the other and, receiving areas of the two ground plane members substantially sandwich the contacts between the two ground plane members.

13. A connector as in claim 10 further comprising means to apply opposite directional forces by the ground plane members against the contacts.

14. A connector as in claim 10 wherein the receiving areas have general teardrop shapes.

15. A filtered electrical connector ground plane member for use in a connector having filtering contacts, the ground plane member comprising:

a center section having two rows of receiving apertures, a majority of the apertures having inwardly directed deflectable barbs; and leg sections extending outwardly from two sides of the center section, each leg section extending from the center section proximate one of the receiving apertures, substantially all of the receiving apertures having a separate leg section associated therewith such that the ground plane member can make electrical contact with contacts at the barbs at the receiving apertures and can contact a housing of the connector at an end of the leg sections whereby a substantially short ground path is provided between each of the apertures and each of their associated leg sections.

16. A ground plane member as in claim 15 wherein the member is comprised of a single sheet of metal, the center section has a general rectangular shape, and the receiving apertures are offset from each other in the two rows.

17. A ground plane member as in claim 15 wherein the barbs, at least at one of the apertures, are not symmetrically arranged.

18. A ground plane member as in claim 15 wherein at least one of the apertures does not have barbs.

19. A filtered electrical connector comprising:

a housing;

a plurality of filtered contacts located, at least partially, in the housing, each filtered contact having a contact member and a tubular capacitor; and a ground plane member connected between the housing and the capacitors of the filtered contacts, the ground plane member having only two rows of contact receiving apertures and two rows of contact legs, each of the filtered contacts being located in one of the receiving apertures and making electrical contact with the ground plane member thereat, each of the contact legs being paired with a separate one of the apertures and making contact with the housing with a uniform grounding path length between each of the contacts and the housing.

20. A connector as in claim 19 wherein the filtered contacts include two end-to-end contact members connected to each other by a contact member connector sleeve crimped onto the two contact members.

21. A connector as in claim 20 wherein the filtered contacts include conductive washers compressed between ends of the capacitor and, a ledge of one of the contact members and an end of the connector sleeve.

22. A connector as in claim 19 wherein the contact legs are spring loaded against interior sides of the housing.

23. An electrical connector comprising:

a housing having an electrically conductive member;

a plurality of contacts located, at least partially, in the housing; and a pair of ground plane members located in the housing and electrically connecting at least one of the contacts to the electrically conductive member of the housing, the ground plane members each comprising a center section with receiving areas and legs extending from the center section, the pair of ground plane members being sandwiched next to each other with the at least one contact passing through a pair of overlapping receiving areas and making electrical contact thereat, and the legs of the ground plane members extending from opposite sides of the center sections, one leg for each of the pairs of overlapping receiving areas.

24. A connector as in claim 23 further comprising means biasing the pair of ground plane members in opposite directions.

25. A connector as in claim 23 wherein the receiving areas are larger than the contacts, but the pair of ground plane members substantially sandwich the contacts between opposite sides of their respective receiving areas.

26. A filtered electrical connector comprising:

an electrically conductive housing;

a plurality of filtered contacts located, at least partially, in the housing, the filtered contacts each including a ceramic tubular capacitor; and at least one ground plane member having a center section and legs extending from the center section, the center section having a plurality of receiving areas with each of the capacitors being located in one of the receiving areas and making electrical contact thereat, wherein the filtered contacts include a first contact member, a second contact member, and a contact member connector to connect the first contact member to the second contact member, each of the capacitors surrounding a portion of the first contact member and being sandwiched between a ledge on the first contact member and an end of the contact member connector.

27. A connector as in claim 26 wherein the contact member connector surrounds portions of the first and second contact members and is crimped thereto.

28. A connector as in claim 26 wherein the housing includes a first housing member made of dielectric material, and a second housing member made of metal, the second housing member having integral lugs on an exterior side thereof adapted to be deformed to fixedly connect a ground wire assembly thereto.

29. A filtered electrical connector comprising:

an electrically conductive housing;

a plurality of filtered contacts located, at least partially, in the housing; and at least two ground plane members each having a center section and legs extending from the center section, the center sections each having a plurality of receiving areas with each of the contacts being located in one of the receiving areas and making electrical contact thereat, wherein the two ground plane members are stacked one on top of the other and, the receiving areas of the two ground plane members substantially sandwich the contacts between the two ground plane members.

30. A connector as in claim 29 wherein each ground plane member has legs extending along one side, but not an opposite side and, the two ground plane members are stacked one on top of the other in opposite orientations such that the legs extend from opposite sides of the stacked ground plane members.

31. A connector as in claim 29 further comprising means to apply opposite directional forces by the ground plane members against the contacts.

* * * * *